US011542126B2

(12) United States Patent
Goto et al.

(10) Patent No.: US 11,542,126 B2
(45) Date of Patent: Jan. 3, 2023

(54) CRANE AND METHOD FOR ACQUIRING LENGTH OF SLINGING TOOL

(71) Applicant: TADANO LTD., Kagawa (JP)

(72) Inventors: Tomokazu Goto, Kagawa (JP); Shinsuke Kanda, Kagawa (JP); Kazuma Mizuki, Kagawa (JP)

(73) Assignee: TADANO LTD., Kagawa (JP)

( * ) Notice: Subject to any disclaimer, the term of this patent is extended or adjusted under 35 U.S.C. 154(b) by 85 days.

(21) Appl. No.: 16/976,317

(22) PCT Filed: Feb. 25, 2019

(86) PCT No.: PCT/JP2019/007098
§ 371 (c)(1),
(2) Date: Aug. 27, 2020

(87) PCT Pub. No.: WO2019/167893
PCT Pub. Date: Sep. 6, 2019

(65) Prior Publication Data

US 2021/0047151 A1 Feb. 18, 2021

(30) Foreign Application Priority Data

Feb. 28, 2018 (JP) ..... JP2018-035208

(51) Int. Cl.
*B66C 13/16* (2006.01)
*B66C 23/00* (2006.01)
*B66C 13/46* (2006.01)

(52) U.S. Cl.
CPC ..... *B66C 13/16* (2013.01); *B66C 13/46* (2013.01); *B66C 23/00* (2013.01); *B66C 2700/08* (2013.01)

(58) Field of Classification Search
CPC ..... B66C 13/16; B66C 23/00; B66C 2700/08; B66C 13/063; B66C 13/46
See application file for complete search history.

(56) References Cited

U.S. PATENT DOCUMENTS

2008/0275610 A1* 11/2008 Terashima ..... B66C 13/063 701/50
2018/0111803 A1* 4/2018 Yamaura ..... B66C 23/701

FOREIGN PATENT DOCUMENTS

JP 06144779 A * 5/1994 ..... B66C 13/46
JP 10120360 A * 5/1998 ..... B66C 13/16
(Continued)

OTHER PUBLICATIONS

JP 2017/190221A Machine Translation (Year: 2017).*
(Continued)

*Primary Examiner* — Michael R Mansen
*Assistant Examiner* — Juan J Campos, Jr.
(74) *Attorney, Agent, or Firm* — Paratus Law Group, PLLC

(57) ABSTRACT

This crane is provided with: a boom; a wire rope suspended down from a leading end section of the boom; a suspender that is fixed to a lower end of the wire rope and is for suspending a slinging tool for hanging a load; a calculation unit that calculates a first load, which is the weight of a member that is suspended down from the suspender; a slinging tool database unit that stores information pertaining to the slinging tool corresponding to the first load; a determination unit that determines whether a load is being suspended from the suspender; and a control unit that acquires the information pertaining to the slinging tool corresponding to the first load from the slinging tool database unit if the load is being suspended, and sets the vertical length of the slinging tool on the basis of the acquired information pertaining to the slinging tool.

7 Claims, 7 Drawing Sheets

(56) References Cited

FOREIGN PATENT DOCUMENTS

| | | | | | |
|---|---|---|---|---|---|
| JP | 11209067 | A | * | 8/1999 | ..... B66C 13/16 |
| JP | 2017190221 | A | * | 10/2017 | ..... B66C 1/12 |
| WO | WO 2005/012155 | A1 | | 2/2005 | |

OTHER PUBLICATIONS

JP 10120360A Machine Translation (Year: 1998).*
JP 06144779A Machine Translation (Year: 1994).*
JP 11209067A Machine Translation (Year: 1999).*
WO 2005/012155A1 (Year: 2005).*

* cited by examiner

CRANE AND METHOD FOR ACQUIRING LENGTH OF SLINGING TOOL

CROSS REFERENCE TO PRIOR APPLICATION

This application is a National Stage Patent Application of PCT International Patent Application No. PCT/JP2019/007098 (filed on Feb. 25, 2019) under 35 U.S.C. § 371, which claims priority to Japanese Patent Application No. 2018-035208 (filed on Feb. 28, 2018), which are all hereby incorporated by reference in their entirety.

TECHNICAL FIELD

The present invention relates to a crane and a method for acquiring a length of a slinging tool.

BACKGROUND ART

Conventionally, in a crane, vibration occurs in a load being conveyed. Such vibration is vibration as a single pendulum having a load suspended down at a leading end of a wire rope as a mass point, or a double pendulum having a hook portion as a fulcrum, with the acceleration applied during conveyance as a vibromotive force.

Further, in addition to the vibration due to the single pendulum or the double pendulum, vibration due to bending of a structure included in a crane such as a telescopic boom or a wire rope occurs in a load conveyed by the crane including the telescopic boom.

The load suspended down on the wire rope vibrates at a resonance frequency of the single pendulum or the double pendulum, and is conveyed while vibrating at a natural frequency in a hoisting direction of the telescopic boom, a natural frequency in a turning direction, and/or a natural frequency at the time of expanding/contracting vibration due to elongation of the wire rope.

In such a crane, in order to stably lower the load to a predetermined position, an operator needs to perform an operation of canceling the vibration of the load by turning or hoisting the telescopic boom through a manual operation using an operation tool. For this reason, conveyance efficiency of the crane is affected by the magnitude of vibration generated during conveyance or a skill level of the crane operator.

Therefore, there is known a crane that suppresses the vibration of the load and improves the conveyance efficiency by damping a frequency component of a resonance frequency of the load from a conveyance instruction (control signal) of an actuator of the crane (see Patent Literature 1).

A crane device described in Patent Literature 1 calculates the resonance frequency from the rope length (hanging length), which is a distance from a center of rotation of oscillation of the wire rope to a center of gravity of the load. Then, the crane device removes a component near the resonance frequency from the conveyance instruction by using a filter unit.

Incidentally, when a resonance frequency of swing of the load from the hanging length is calculated, it is necessary to calculate a length from a boom leading end section to the load. The length from the boom leading end section to the load is a value obtained by adding a length from the boom leading end section to a hook and a length from the hook to the load.

The length from the boom leading end section to the hook can be calculated based on the amount of reeling out of the wire rope (length of the wire rope) and the number of times of winding the wire rope around the hook. However, in practice, in order to calculate the resonance frequency of the swing of the load from the hanging length of the load, the length from the boom leading end section to the hook and the length of the slinging tool to be hung on the hook are required. In this case of acquiring the length of the slinging tool hung on the hook, various measuring devices, etc. for measuring the length of the slinging tool are required. Such a measuring device has a complicated device configuration and increases the manufacturing cost. Therefore, there is a demand for a technology for easily acquiring the length of the slinging tool without requiring various measuring devices, etc. for measuring the length of the slinging tool.

CITATION LIST

Patent Literature

Patent Literature 1: WO 2005/012155 A

SUMMARY OF THE INVENTION

Problems to be Solved by the Invention

An object of the invention is to provide a crane capable of easily acquiring a length of a slinging tool according to a lifting load of the crane, and a method for acquiring the length of the slinging tool.

Solutions to Problems

An aspect of a crane according to the invention includes a boom, a wire rope that is suspended down from a leading end section of the boom, a suspender that is fixed to a lower end of the wire rope and is for suspending a slinging tool for hanging a load, a calculation unit that calculates a first load, which is a weight of a member that is suspended down from the suspender, a slinging tool database unit that stores information pertaining to the slinging tool corresponding to the first load, a determination unit that determines whether the load is being suspended from the suspender, and a control unit that acquires the information pertaining to the slinging tool corresponding to the first load from the slinging tool database unit when the load is being suspended, and sets a vertical length of the slinging tool on the basis of the acquired information pertaining to the slinging tool.

A method for acquiring a length of a slinging tool according to the invention is a method for acquiring a vertical length of a slinging tool executed in a crane including a boom, a wire rope that is suspended down from a leading end section of the boom, and a suspender that is fixed to a lower end of the wire rope and is for suspending the slinging tool for hanging a load, the method including calculating a first load, which is a weight of a member that is suspended down from the suspender, acquiring information pertaining to the slinging tool corresponding to the first load from a slinging tool database unit that stores the information pertaining to the slinging tool corresponding to the first load when the load is being suspended, and setting a vertical length of the slinging tool on the basis of the acquired information pertaining to the slinging tool.

Effects of the Invention

According to the invention, it is possible to provide a crane capable of easily acquiring a length of a slinging tool according to a lifting load of the crane, and a method for acquiring the length of the slinging tool.

DESCRIPTION OF EMBODIMENTS

Hereinafter, a description will be given of a crane 1 according to an embodiment of the invention with reference to FIGS. 1 and 2. Note that even though a mobile crane (rough terrain crane) will be described as the crane 1 in the present embodiment, a truck crane, etc. may be used.

Figure 1:
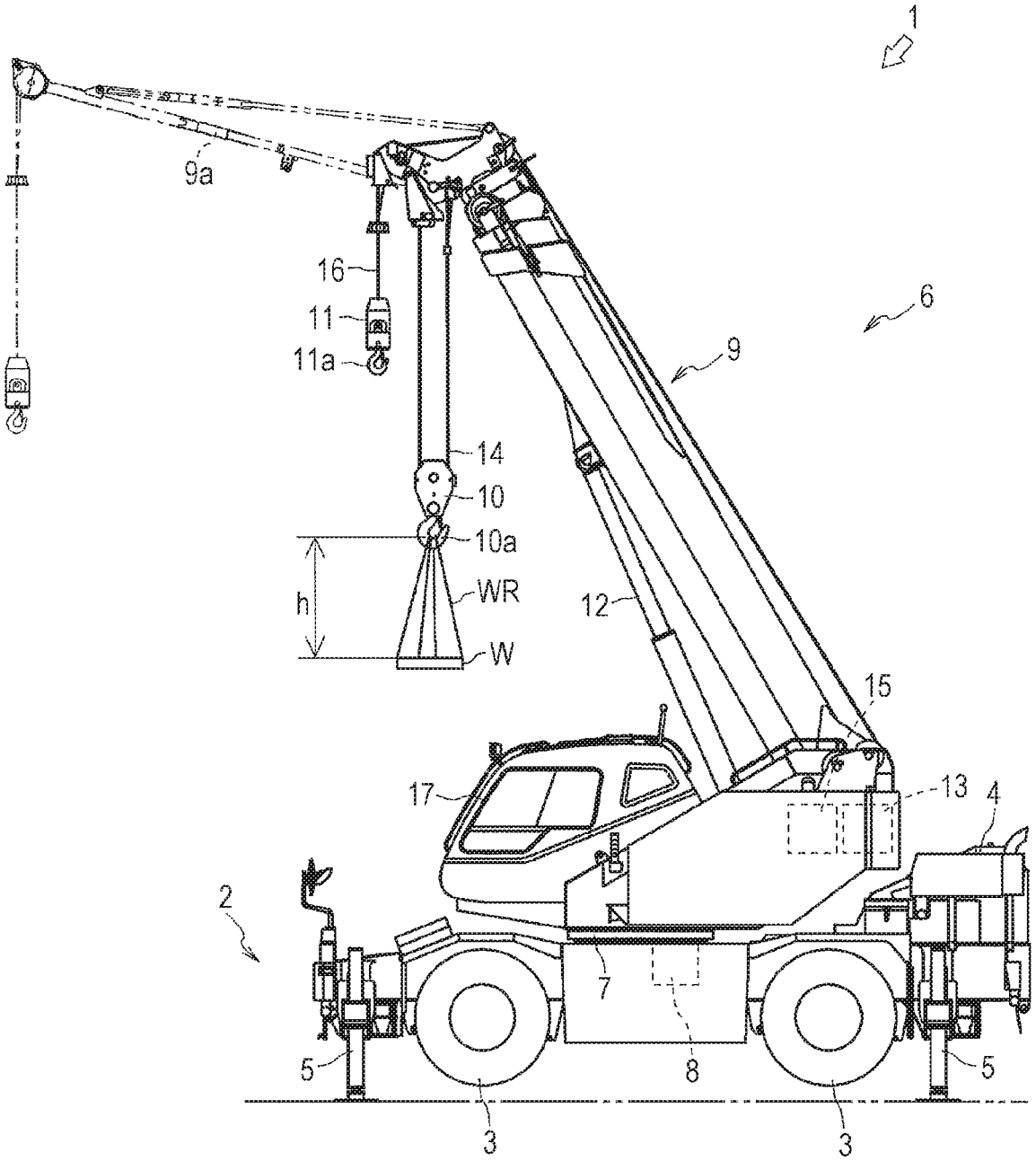
FIG. 1 is a side view illustrating an overall configuration of a crane according to an embodiment of the invention.

As illustrated in FIG. 1, the crane 1 is a mobile crane that can move to an unspecified place. The crane 1 has a vehicle 2 and a crane device 6.

The vehicle 2 conveys the crane device 6. The vehicle 2 has a plurality of wheels 3 and runs using an engine 4 as a power source. The vehicle 2 has an outrigger 5. The outrigger 5 has a projecting beam and a jack cylinder. The projecting beam can be hydraulically extended to both sides of the vehicle 2 in a width direction. The jack cylinder is fixed to a leading end section of the projecting beam and can extend in a direction perpendicular to the ground. The vehicle 2 can extend a workable range of the crane 1 by extending the outrigger 5 in the width direction of the vehicle 2 and grounding the jack cylinder.

The crane device 6 lifts a load W by a slinging wire rope WR which is an example of a slinging tool. The crane device 6 includes a turning table 7, a boom 9, a jib 9*a*, a main hook block 10, a sub-hook block 11, a hoisting hydraulic cylinder 12, a main winch 13, a main wire rope 14, a sub-winch 15, a sub-wire rope 16, a cabin 17, etc.

The turning table 7 supports the crane device 6 with respect to the vehicle 2 so that the crane device 6 can turn. The turning table 7 is provided on a frame of the vehicle 2 via an annular bearing. The turning table 7 is configured to be rotatable around a center of the annular bearing as a center of rotation. The turning table 7 has a hydraulic turning hydraulic motor 8 that is an actuator. The turning table 7 turns in a first direction or a second direction by the turning hydraulic motor 8.

The turning hydraulic motor 8 which is an actuator is rotationally operated by a turning valve 31 (see FIG. 2) which is an electromagnetic proportional switching valve. The turning valve 31 can adjust a flow rate of hydraulic oil supplied to the turning hydraulic motor 8 to an arbitrary flow rate. That is, the turning table 7 is adjusted to an arbitrary turning speed via the turning hydraulic motor 8 operated by the turning valve 31. The turning table 7 has a turning sensor 25 (see FIG. 2) that detects a turning position (angle) and a turning speed of the turning table 7.

The boom 9 supports the wire rope so that the load 51 can be lifted. The boom 9 includes a plurality of boom members. The boom 9 expands and contracts in an axial direction by moving each boom member using an expansion/contraction hydraulic cylinder (not illustrated) that is an actuator. A base end of a base boom member of the boom 9 is supported at substantially a center of the turning table 7 so that the base end can swing.

An expansion/contraction hydraulic cylinder (not illustrated) which is an actuator is expanded and contracted by an expansion/contraction operation valve 32 (see FIG. 2) which is an electromagnetic proportional switching valve. The expansion/contraction operation valve 32 can adjust a flow rate of hydraulic oil supplied to an expansion/contraction hydraulic cylinder to an arbitrary flow rate.

That is, the boom 9 is adjusted to an arbitrary boom length by the expansion/contraction operation valve 32. The boom 9 has a boom length detection sensor 26 and a weight sensor 27 (see FIG. 2) which is lifting load detection means. The boom length detection sensor 26 detects the length of the boom 9. The weight sensor 27 detects a weight Wm of the load W, etc. applied to the main wire rope 14 via a main hook 10*a*. In addition, the weight sensor 27 detects a weight Ws of the load W, etc. applied to the sub-wire rope 16 via the sub-hook 11*a*.

Note that a weight Wm·Ws of the load W, etc. refers to, for example, a weight obtained adding the weight of the load W and a weight of the slinging wire rope WR. In addition, when the main hook 10*a* is used, the weight sensor 27 can detect, as a lifting load, a weight obtained by adding a rope weight corresponding to an amount of reeling out of the main wire rope 14, a weight of the main hook block 10, the weight of the load W, and the weight of the slinging wire rope WR. Note that a sum of the weight of the load W and the weight of the slinging wire rope WR corresponds to an example of a first load.

In addition, when the sub-hook 11*a* is used, the weight sensor 27 can detect, as a lifting load, a weight obtained by adding a rope weight corresponding to an amount of reeling out of the sub-wire rope 16, a weight of the sub-hook block 11, the weight of the load W, and the weight of the slinging wire rope WR.

The jib 9*a* expands a lift or working radius of the crane device 6. The jib 9*a* is held by a jib support portion provided on the base boom member of the boom 9 in a posture along the base boom member. A base end of the jib 9*a* is connectable to a jib support portion of a top boom member.

The main hook block 10 and the sub-hook block 11 are suspenders for suspending the load W. The main hook block 10 is provided with a plurality of hook sheaves around which the main wire rope 14 is wound, and the main hook 10*a* for suspending the load W via the slinging wire rope WR. The weight of the main hook block 10 may be regarded as the weight including the hook sheaves and the main hook 10*a*.

The sub-hook block 11 is provided with the sub-hook 11*a* for suspending the load W via the slinging wire rope WR. The weight of the sub-hook block 11 may be regarded as the weight including the sub-hook 11*a*.

The hoisting hydraulic cylinder 12, which is an actuator, raises and lowers the boom 9 to hold the posture of the boom 9. The hoisting hydraulic cylinder 12 has a cylinder portion and a rod portion. An end section of the cylinder portion is swingably connected to the turning table 7. An end section of the rod portion is swingably connected to the base boom member of the boom 9.

The hoisting hydraulic cylinder 12 is expanded and contracted by a hoisting valve 33 (see FIG. 2) which is an electromagnetic proportional switching valve. The hoisting valve 33 can adjust a flow rate of hydraulic oil supplied to the hoisting hydraulic cylinder 12 to an arbitrary flow rate. That is, the boom 9 is adjusted to an arbitrary hoisting speed by the hoisting valve 33. The boom 9 is provided with a hoisting sensor 28 (see FIG. 2) that detects a hoisting angle of the boom 9.

The main winch 13 and the sub-winch 15 reels in (winds) and reels out (unwind) the main wire rope 14 and the sub-wire rope 16. The main winch 13 includes a main drum around which the main wire rope 14 is wound, and a main hydraulic motor (not illustrated) which is an actuator that rotationally drives the main drum.

The sub-winch 15 includes a sub-drum around which the sub-wire rope 16 is wound, and a sub-hydraulic motor (not illustrated) which is an actuator that rotationally drives the sub-drum. Note that in the present embodiment, the main winch 13 and the sub-winch 15 are provided near a base end section of the boom 9. However, for example, the main winch or the sub-winch may be provided at the leading end section of the boom 9.

The main hydraulic motor is rotated by a main valve 34 (see FIG. 2) which is an electromagnetic proportional switching valve. The main valve 34 can adjust a flow rate of hydraulic oil supplied to the main hydraulic motor to an arbitrary flow rate.

That is, the main winch 13 is adjusted to an arbitrary reeling in and reeling out speed by the main valve 34. Similarly, the sub-winch 15 is adjusted to an arbitrary reeling in and reeling out speed by the sub-valve 35 (see FIG. 2), which is an electromagnetic proportional switching valve. The main winch 13 is provided with a main reeling out amount detection sensor 29. Similarly, the sub-winch 15 is provided with a sub-reeling out amount detection sensor 30.

The cabin 17 covers a cockpit. The cabin 17 is mounted on the turning table 7. Inside the cabin 17, the cockpit (not illustrated) is provided. In the cockpit, an operation tool for operating driving of the vehicle 2, a turning operation tool 18 for operating the crane device 6, a hoisting operation tool 19, an expansion/contraction operation tool 20, a main drum operation tool 21, a sub-drum operation tool 22, etc. are provided (see FIG. 2).

The turning operation tool 18 controls the turning hydraulic motor 8 by operating the turning valve 31. The hoisting operation tool 19 controls the hoisting hydraulic cylinder 12 by operating the hoisting valve 33. The expansion/contraction operation tool 20 controls the expansion/contraction hydraulic cylinder by operating the expansion/contraction operation valve 32.

The main drum operation tool 21 controls the main hydraulic motor by operating the main valve 34. The sub-drum operation tool 22 controls the sub-hydraulic motor by operating the sub-valve 35.

The crane 1 configured as described above can move the crane device 6 to an arbitrary position by running the vehicle 2. In addition, the crane 1 can change the lift of the crane device 6 by raising the boom 9 to an arbitrary hoisting angle using the hoisting hydraulic cylinder 12 through an operation of the hoisting operation tool 19. In addition, the crane 1 can change the working radius of the crane device 6 by extending the boom 9 to an arbitrary length by operating the expansion/contraction operation tool 20.

In addition, the crane 1 can convey the load W by lifting the load W using the main drum operation tool 21, etc. to turn the turning table 7 through an operation of the turning operation tool 18.

Next, the control device 36 included in the crane device 6 will be described with reference to FIG. 2. The control device 36 may be regarded as an example of the control unit. Note that in FIG. 1 and FIG. 5, the crane device 6 is in a state of performing an operation of lifting the load N by the main hook 10*a*. In the present embodiment, the crane device 6 will be specifically described by taking as an example a case where an operation of lifting the load W is performed using the main hook 10*a*.

Figure 2:
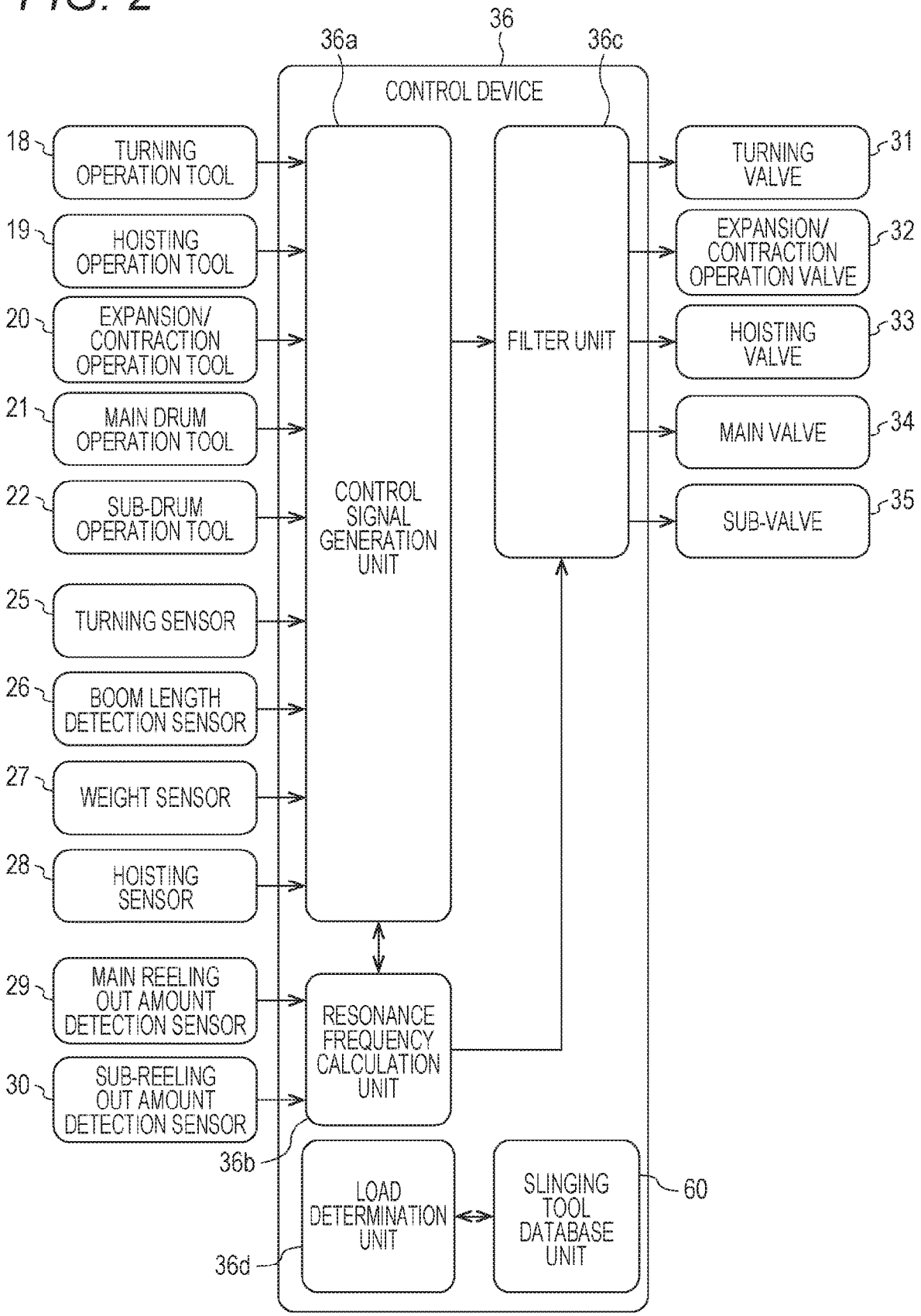
FIG. 2 is a block diagram illustrating a configuration of a control device of the crane.

As illustrated in FIG. 2, the control device 36 has a function of controlling the actuator of the crane 1 via each operation valve, and a function of acquiring various information of the crane device 6 to perform determination/calculation. For example, the control device 36 acquires a vertical length h of the slinging tool by determining whether the load W is present (suspended) or the load W is not present and only the main hook block 10 is present based on a lifting load by the main wire rope 14.

Here, the vertical length h of the slinging tool in the present embodiment is a vertical height dimension of the slinging tool. Specifically, as illustrated in FIGS. 1, 6, 8A and 8B, the vertical length h is a vertical length dimension from an upper end of the slinging wire rope WR hung on the main hook 10*a* to a lower end of the slinging wire rope WR in a state where both end portions of the slinging wire rope WR are attached to an upper end portion of the load W when the load W is lifted by the main hook 10*a* using the slinging wire rope WR which is an example of the slinging tool.

The control device 36 includes a control signal generation unit 36*a*, a resonance frequency calculation unit 36*b*, and a filter unit 36*c*. The control device 36 is provided in the cabin 17. The control device 36 may actually have a configuration in which a CPU, a ROM, a RAM, an HDD, etc. are connected by a bus, or may be configured by a one-chip LSI, etc.

The control device 36 stores various programs for controlling the operation of the crane device 6 and data for obtaining the vertical length h of the slinging tool. In addition, the control device 36 stores various programs and data for controlling the operations of the control signal generation unit 36*a*, the resonance frequency calculation unit 36*b*, and the filter unit 36*c*.

The weight sensor 27 is connected to the control device 36. For example, the weight sensor 27 includes a load cell, and a detection signal thereof is sent to a load determination unit 36*d* (see FIG. 2) of the control device 36. The weight sensor 27 corresponds to an example of a lifting load detection unit.

The load determination unit 36*d* is a part of the control device 36, and is connected to the weight sensor 27. For example, the load determination unit 36*d* determines whether or not the lifting load detected by the weight sensor 27 is equal to or greater than a predetermined threshold value (also referred to as a first threshold value). The load determination unit 36*d* corresponds to an example of a determination unit.

Although details will be described later, the control device 36 includes a slinging tool database unit 60 that saves data obtained by associating the load applied to the hook (in the present embodiment, the main hook 10*a*) with the vertical length h (see FIGS. 1 and 5) of the slinging tool (slinging wire rope WR) corresponding to the load applied to the hook.

Further, the slinging tool database unit 60 is configured to be able to output the saved data in response to a request from the control device 36. Note that for example, the "slinging tool corresponding to the load applied to the hook" refers to a slinging tool that is frequently used under a load applied to a predetermined hook.

In addition to the data obtained by associating the load applied to the hook with the vertical length h of the slinging tool corresponding to the load applied to the hook described above, for example, the slinging tool database unit 60 saves specification information of various slinging wires.

Examples of the specification information include the weight for each type of slinging wire rope WR (for each applied load shape, for each allowable load, etc.), the suspending angle θw (see FIG. 8A) at the time of using the slinging wire rope WR (for example, for each weight), a wire length Lw (see FIG. 8B) of the slinging wire rope WR, a diameter of each type of slinging wire rope WR (for each applied load), etc.

The control signal generation unit 36*a* is a part of the control device 36 and generates a control signal that is a speed instruction for each actuator. The control signal generation unit 36*a* acquires the operation amount of each operation tool from the turning operation tool 18, the hoisting operation tool 19, the expansion/contraction operation tool 20, the main drum operation tool 21, the sub-drum operation tool 22, etc.

In addition, the control signal generation unit 36*a* acquires a turning position of the turning table 7, a boom length, a hoisting angle, and the weight Wm·Ws of the load W, etc. from the turning sensor 25, the boom length detection sensor 26, the weight sensor 27, and the hoisting sensor 28.

The control signal generation unit 36*a* is configured to generate a control signal C(1) of the turning operation tool 18, a control signal C(2)••a control signal C(n) of the hoisting operation tool 19 (hereinafter simply collectively referred to as a "control signal C(n)", n is an arbitrary number) from the acquired operation amount of each operation tool or a state of the crane 1.

The resonance frequency calculation unit 36*b* is a part of the control device 36. The resonance frequency calculation unit 36*b* calculates a resonance frequency ω(n) of the swing of the load W using the load W suspended down on the main wire rope 14 or the sub-wire rope 16 as a single pendulum.

The resonance frequency calculation unit 36*b* acquires the hoisting angle of the boom 9 acquired by the control signal generation unit 36*a*. The resonance frequency calculation unit 36*b* acquires the amount Lm (n) reeling out of the main wire rope 14 and the amount Ls(n) of reeling out of the sub-wire rope 16 (see FIG. 5) from the main reeling out amount detection sensor 29 or the sub-reeling out amount detection sensor 30. Note that the resonance frequency calculation unit 36*b* may acquire the amount of reeling out of the wire rope corresponding to one of the main hook and the sub-hook to be used.

When the main hook block 10 is used, the resonance frequency calculation unit 36*b* acquires the hanging number of the main hook block 10 from a safety device (not illustrated).

Further, the resonance frequency calculation unit 36*b* calculates the amount Lm (n) of reeling out of the main wire rope 14 from a position where the main wire rope 14 is separated from the sheave to the main hook block 10 based on the acquired hoisting angle of the boom 9 and hanging number of the main hook block 10 when the main hook block 10 is used. In other words, the resonance frequency calculation unit 36*b* calculates the length (amount of reeling out) of the main wire rope 14 between the sheave and the main hook block 10 based on the hoisting angle of the boom 9 and the hanging number of the main hook block 10 when the main hook block 10 is used.

Figure 5:
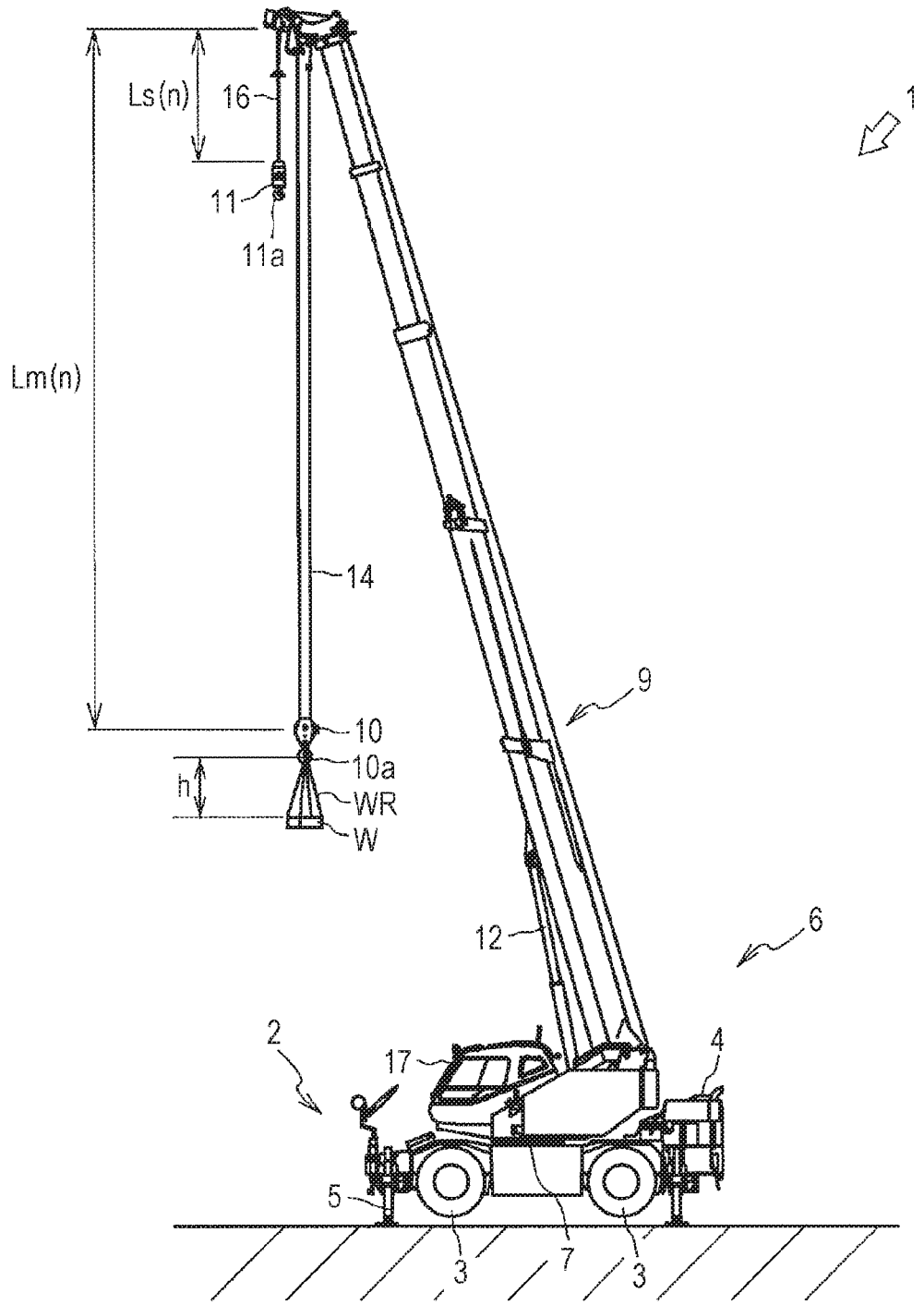
FIG. 5 is a side view illustrating an overall configuration of the crane in a state where a load is suspended on a main hook and a sub-hook is not used.

In addition, the resonance frequency calculation unit 36*b* calculates the amount Ls(n) of reeling out of the sub-wire rope 16 from a position where the sub-wire rope 16 is separated from the sheave to the sub-hook block 11 (see FIG. 5). In other words, the resonance frequency calculation unit 36*b* calculates the length (amount of reeling out) of the sub-wire rope 16 between the sheave and the sub-hook block 11.

The filter unit 36*c* is a part of the control device 36. The filter unit 36*c* generates a notch filter F(1)•F(2)••F(n) (hereinafter simply collectively referred to as a "notch filter F (n)", n is an arbitrary number) that attenuates a specific frequency region of a control signal C(1)•C(2)••C(n).

The filter unit 36*c* applies the notch filter F (n) to the control signal C (n). The filter unit 36*c* acquires the turning position of the turning table 7, the boom length, the hoisting angle, the weight Wm·Ws of the load W, etc., the control signal C(1), the control signal C(2)••the control signal C(n) from the control signal generation unit 36*a*. Further, the filter unit 36*c* acquires the resonance frequency ω(n) from the resonance frequency calculation unit 36*b*.

The filter unit 36*c* applies the notch filter F (1) to the control signal C(1) and generates a filtering control signal Cd(1) in which a frequency component in an arbitrary frequency range is attenuated at an arbitrary ratio with respect to the resonance frequency ω(1) from the control signal C(1).

Similarly, the filter unit 36*c* applies the notch filter F(2) to the control signal C(2) to generate a filtering control signal Cd(2). In other words, the filter unit 36*c* is configured to apply the notch filter F(n) to the control signal C(n) and generate a filtering control signal Cd(n) (hereinafter simply collectively referred to as a "filtering control signal Cd(n)", n is an arbitrary number) in which a frequency component in an arbitrary frequency range is attenuated at an arbitrary ratio with respect to the resonance frequency ω(n) from the control signal C(n).

The filter unit 36*c* transmits the filtering control signal Cd(n) to the corresponding operation valve among the turning valve 31, the expansion/contraction operation valve 32, the hoisting valve 33, the main valve 34, and the sub-valve 35.

That is, the control device 36 is configured to be able to control the turning hydraulic motor 8, which is an actuator, the hoisting hydraulic cylinder 12, and the main hydraulic motor and the sub-hydraulic motor (not illustrated) via each operation valve.

The control signal generation unit 36*a* is connected to the turning operation tool 18, the hoisting operation tool 19, the expansion/contraction operation tool 20, the main drum operation tool 21, and the sub-drum operation tool 22. The control signal generation unit 36*a* acquires the operation amount of each of the turning operation tool 18, the hoisting operation tool 19, the main drum operation tool 21, and the sub-drum operation tool 22.

Further, the control signal generation unit 36*a* is connected to the turning sensor 25, the boom length detection sensor 26, the weight sensor 27, and the hoisting sensor 28. The control signal generation unit 36*a* acquires the turning position of the turning table 7, the boom length, the hoisting angle, and the weight Wm·Ws of the load W, etc. from each of these sensors.

In addition, the control signal generation unit 36*a* is connected to the resonance frequency calculation unit 36*b*. The control signal generation unit 36*a* acquires the amount Lm (n) of reeling out of the main wire rope 14, the amount Ls (n) of reeling out of the sub-wire rope 16 (see FIG. 5), and/or the resonance frequency ω(n) from the resonance frequency calculation unit 36*b*.

The resonance frequency calculation unit 36*b* is connected to the main reeling out amount detection sensor 29, the sub-reeling out amount detection sensor 30, and the safety device (not illustrated). The resonance frequency calculation unit 36*b* calculates the amount Lm (n) of reeling out of the main wire rope 14 and/or the amount Ls (n) of reeling out of the sub-wire rope 16.

The filter unit 36*c* is connected to the control signal generation unit 36*a*. The filter unit 36*c* acquires the turning position of the turning table 7, the boom length, the hoisting angle, the weight Wm·Ws of the load W, etc., and the control signal C (n) from the control signal generation unit 36*a*.

Further, the filter unit 36*c* is connected to the resonance frequency calculation unit 36*b*. The filter unit 36*c* can acquire the resonance frequency ω(n) from the resonance frequency calculation unit 36*b*. Further, the filter unit 36*c* is connected to the turning valve 31, the expansion/contraction operation valve 32, the hoisting valve 33, the main valve 34, and the sub-valve 35. The filter unit 36*c* generates and transmits the corresponding filtering control signal Cd(n) to the turning valve 31, the hoisting valve 33, the main valve 34, and the sub-valve 35.

Here, the notch filter F(n) will be described with reference to FIGS. 3 and 4. The notch filter F(n) is a filter that gives a steep attenuation to the control signal C (n) centered around an arbitrary frequency.

Figure 3:
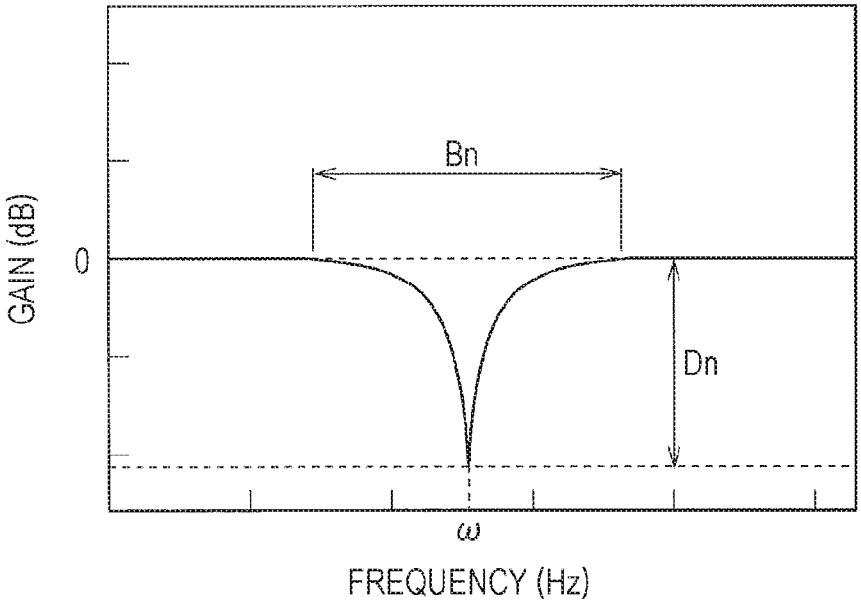
FIG. 3 is a view illustrating a graph showing a frequency characteristic of a notch filter.

As shown in FIG. 3, the notch filter F(n) is a filter having a frequency characteristic that attenuates a frequency component of a notch width Bn, which is an arbitrary frequency range centered around an arbitrary center frequency ωc(n), with a notch depth Dn, which is an attenuation ratio of an arbitrary frequency at the center frequency ωc(n).

That is, the frequency characteristic of the notch filter F (n) is determined by the center frequency ωc(n), the notch width Bn, and the notch depth Dn.

The notch filter F (n) has a transfer function H (s) shown in the following Equation (1).

[Equation 1]

$$H(s) = \frac{s^2 + 2\delta\zeta\omega_n s + \omega_n^2}{s^2 + 2\zeta\omega_n s + \omega_n^2} \quad (1)$$

In Equation (1), ωn is a center frequency coefficient ωn corresponding to the center frequency ωc(n) of the notch filter F(n). ζ is a notch width coefficient ζ corresponding to the notch width Bn. δ is a notch depth coefficient δ corresponding to the notch depth Dn.

A characteristic of the notch filter F(n) is represented by a load shake reduction rate determined by the notch width coefficient ζ and the notch depth coefficient δ. The load shake reduction rate is a rate determined by the notch width coefficient ζ and the notch depth coefficient δ in the transfer function H(s) of the notch filter F(n).

The control device 36 configured in this way generates the control signal C(n) corresponding to each operation tool based on the operation amounts of the turning operation tool 18, the hoisting operation tool 19, the main drum operation tool 21, and the sub-drum operation tool 22 the control signal generation unit 36*a*.

The control device 36 calculates the amount Lm(n) of reeling out of the main wire rope 14 or the amount Ls(n) of reeling out of the sub-wire rope 16, and calculates the resonance frequency ω(n) based on the gravitational acceleration g and the amount Lm(n) of reeling out or the amount Ls(n) of reeling out in the resonance frequency calculation unit 36*b*.

Further, the control device 36 calculates the notch width coefficient ζ and the notch depth coefficient δ corresponding to the control signal C(n) from the control signal C(n), the turning position of the turning table 7, the boom length and the hoisting angle of the boom 9, and the weight Wm·Ws of the load W, etc. in the filter unit 36*c*.

The control device 36 calculates the corresponding center frequency coefficient on using the resonance frequency ω(n) calculated by the resonance frequency calculation unit 36*b* as the reference center frequency ωc(n) of the notch filter F(n).

Figure 4:
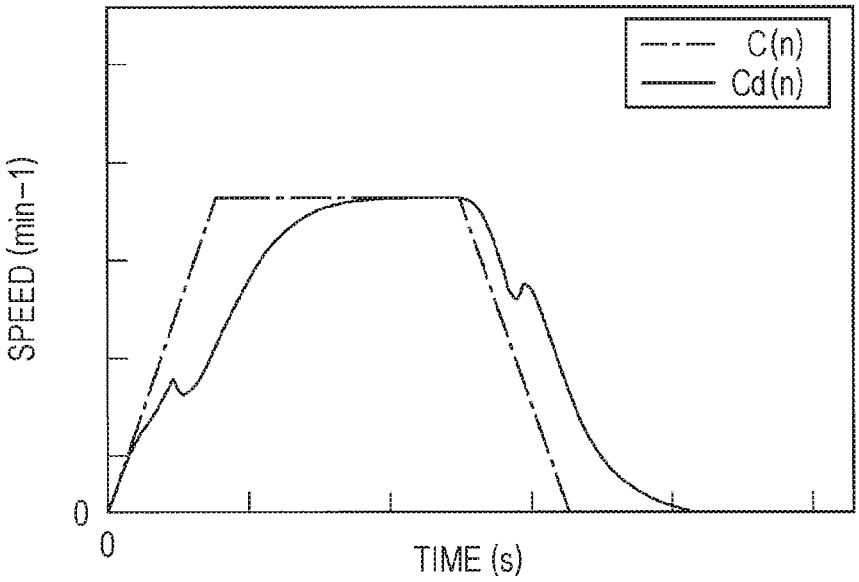
FIG. 4 is a view illustrating a graph showing a control signal and a filtering control signal to which the notch filter is applied.

As shown in FIG. 4, the control device 36 generates the filtering control signal Cd(n) by applying the notch filter F(n), to which the notch width coefficient ζ, the notch depth coefficient δ, and the center frequency coefficient ωn are applied, to the control signal C(n) in the filter unit 36*c*.

The filter unit 36*c* transmits the filtering control signal Cd(n) to the corresponding valve among the turning valve 31, the expansion/contraction operation valve 32, the hoisting valve 33, the main valve 34, and the sub-valve 35, and controls the turning hydraulic motor 8, which is an actuator, the hoisting hydraulic cylinder 12, the main hydraulic motor (not illustrated), and the sub-hydraulic motor (not illustrated).

Method for Acquiring Slinging Tool Length (First Embodiment)

Next, a method for acquiring the vertical length h of the slinging tool executed by the control device 36 will be specifically described with reference to FIG. 6.

First, in step S10, for example, the control device 36 determines one of the main hook block 10 (main hook 10*a*) and the sub-hook block 11 (sub-hook 11*a*) used to perform a lifting operation from operation states of the main drum operation tool 21 and the sub-drum operation tool 22. Then, the control device 36 causes a control process to proceed to step S20.

Subsequently, in step S20, the control device 36 acquires the amount of reeling out of the wire rope of the used hook. The, the control device 36 calculates the weight of the wire rope reeled out from the leading end of the boom 9 corresponding to the amount of reeling out. The control device 36 calculates the weight of the wire rope reeled out from the leading end of the boom 9 based on the acquired amount of reeling out of the wire rope and information pertaining to the stored weight of the wire rope per unit length. Thereafter, the control device 36 causes the control process to proceed to step S30.

Subsequently, in step S30, the control device 36 sets, as a threshold value, a value obtained by adding the weight of the wire rope reeled out calculated in step S20 to the weight of the used hook block. Then, the control device 36 causes the control process to proceed to step S40. Step S30 corresponds to an example of a setting process of setting a predetermined threshold value.

Subsequently, in step S40, the control device 36 calculates a lifting load based on a change in the detection value (load) of the weight sensor 27. Then, the control device 36 causes the control process to proceed to step 50. Specifically, the control device 36 acquires the detection value (load) of the weight sensor 27 when the detection value becomes constant as the lifting load. Then, the control device 36 causes the control process to proceed to step S50. Step S40 corresponds to an example of a calculation process for calculating the lifting load from the change in the load by the weight sensor 27.

Subsequently, in step S50, the control device 36 determines whether or not the lifting load is larger than a predetermined threshold value. As a result, when it is determined that the lifting load is larger than the predetermined threshold value ("YES" in step S50), the control device 36 causes the control process to proceed to step S60.

On the other hand, when it is determined that the lifting load is less than or equal to the predetermined threshold value ("NO" in step S50), the control device 36 causes the control process to proceed to step S100. Step S50 corresponds to an example of a determination process of determining whether or not the lifting load is larger than the predetermined threshold value. In addition, steps S20 to S50 correspond to an example of a process in which the control unit determines whether or not the crane 1 is in a state of lifting a load.

Subsequently, in step S60, the control device 36 acquires the load applied to the hook. That is, the control device 36 subtracts the rope weight corresponding to the amount of reeling out of the wire rope and the weight of the hook block from the lifting load, and acquires the load applied to the hook. Then, the control device 36 causes the control process to proceed to step S70. The control device 36 may be regarded as an example of the calculation unit.

In step S70, the control device 36 acquires the vertical length h of the slinging tool corresponding to the load applied to the hook from the slinging tool database unit 60. That is, the control device 36 sets a slinging tool frequently used under the load according to the load applied to the hook.

Figure 8A:
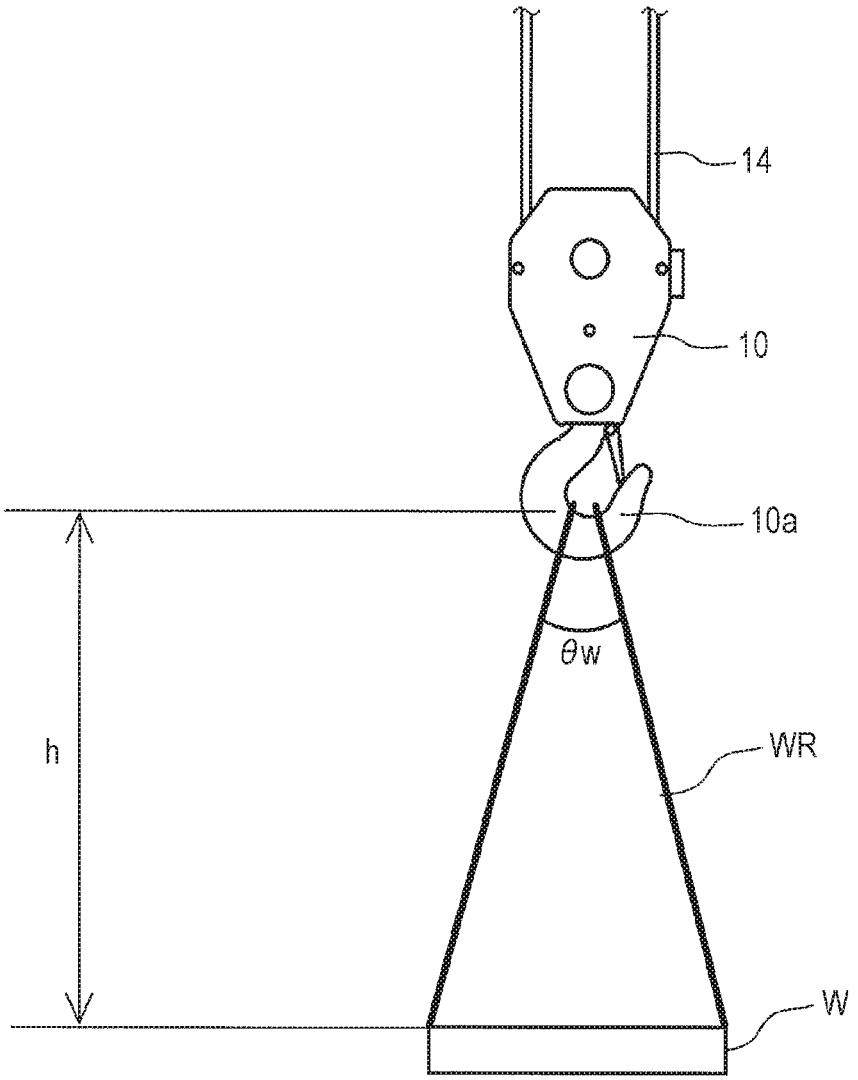
FIG. 8A is a diagram illustrating a suspending angle of the slinging tool when the load is lifted by the slinging tool.
Figure 8B:
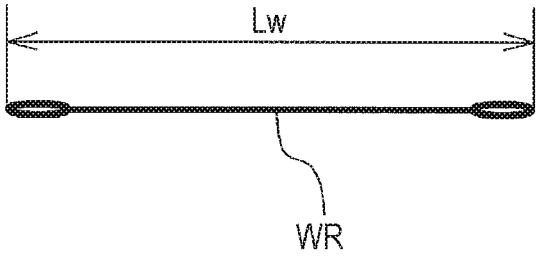
FIG. 8B is a diagram illustrating a slinging wire rope.

As an example, as illustrated in FIGS. 8A and 8B, when the slinging tool is two slinging wire ropes WR, the control device 36 calculates the vertical length h of the slinging tool based on the preset suspending angle θw corresponding to the slinging wire ropes WR and the wire length Lw when the slinging wire ropes WR are linearly extended ($h=Lw\times\cos\theta w$). Then, the control device 36 ends the control process illustrated in FIG. 6.

Subsequently, in step S100, the control device 36 sets the vertical length h of the slinging tool to zero. Then, the control device 36 ends the control process illustrated in FIG. 6.

The vertical length h of the slinging tool acquired by the slinging tool length acquisition method according to the present embodiment can be used when the resonance frequency ω(n) of the swing of the load W is calculated based on a hanging length of the load W from the leading end section of the boom 9. Note that a method of calculating the resonance frequency ω(n) may be a known method.

In the crane 1 configured in this way, when the lifting load is larger than a predetermined threshold value, the control device 36 determines that the load W is being lifted via the slinging wire rope WR. Then, the control device 36 acquires, from the slinging tool database unit 60, specifications (suspending angle θw and wire length Lw) of the slinging wire rope WR corresponding to the load applied to the hook calculated based on the lifting load. Then, the control device 36 acquires the vertical length h of the slinging wire rope WR based on the acquired specifications. Then, the control device 36 sets the acquired value as the vertical length h of the slinging wire rope WR. On the other hand, when the lifting load is less than or equal to the predetermined threshold value, the control device 36 determines that the load W is not being lifted via the slinging wire rope WR. Then, the control device 36 sets the vertical length h of the slinging wire rope WR to zero. In this way, it is possible to simply and easily acquire the vertical length h of the slinging wire rope WR without the need for various measuring devices, etc. for measuring the vertical length h of the slinging wire rope WR. Furthermore, it is possible to obtain the hanging length of the load W from the leading end section of the boom 9 using the vertical length h of the slinging wire rope WR acquired or set in this way. Therefore, the resonance frequency ω(n) of the swing of the load W can be accurately calculated.

Method for Acquiring Vertical Length of Slinging Tool (Second Embodiment)

Figure 7:
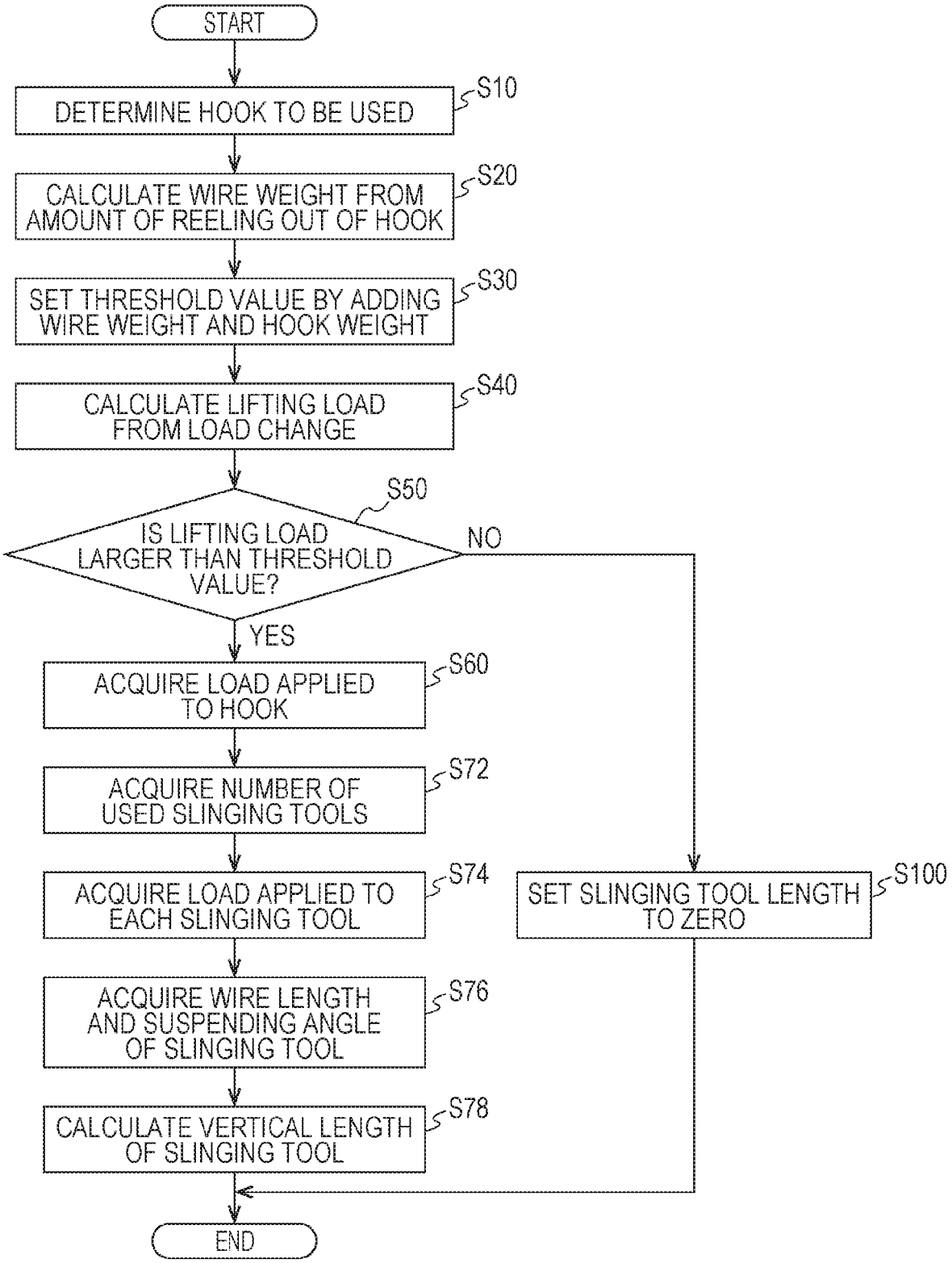
FIG. 7 is a diagram illustrating a flowchart illustrating a control mode according to a second embodiment of the control device of the crane.

Next, a method for acquiring the vertical length h of the slinging tool according to a second embodiment of the invention will be described with reference to FIG. 7.

Figure 6:
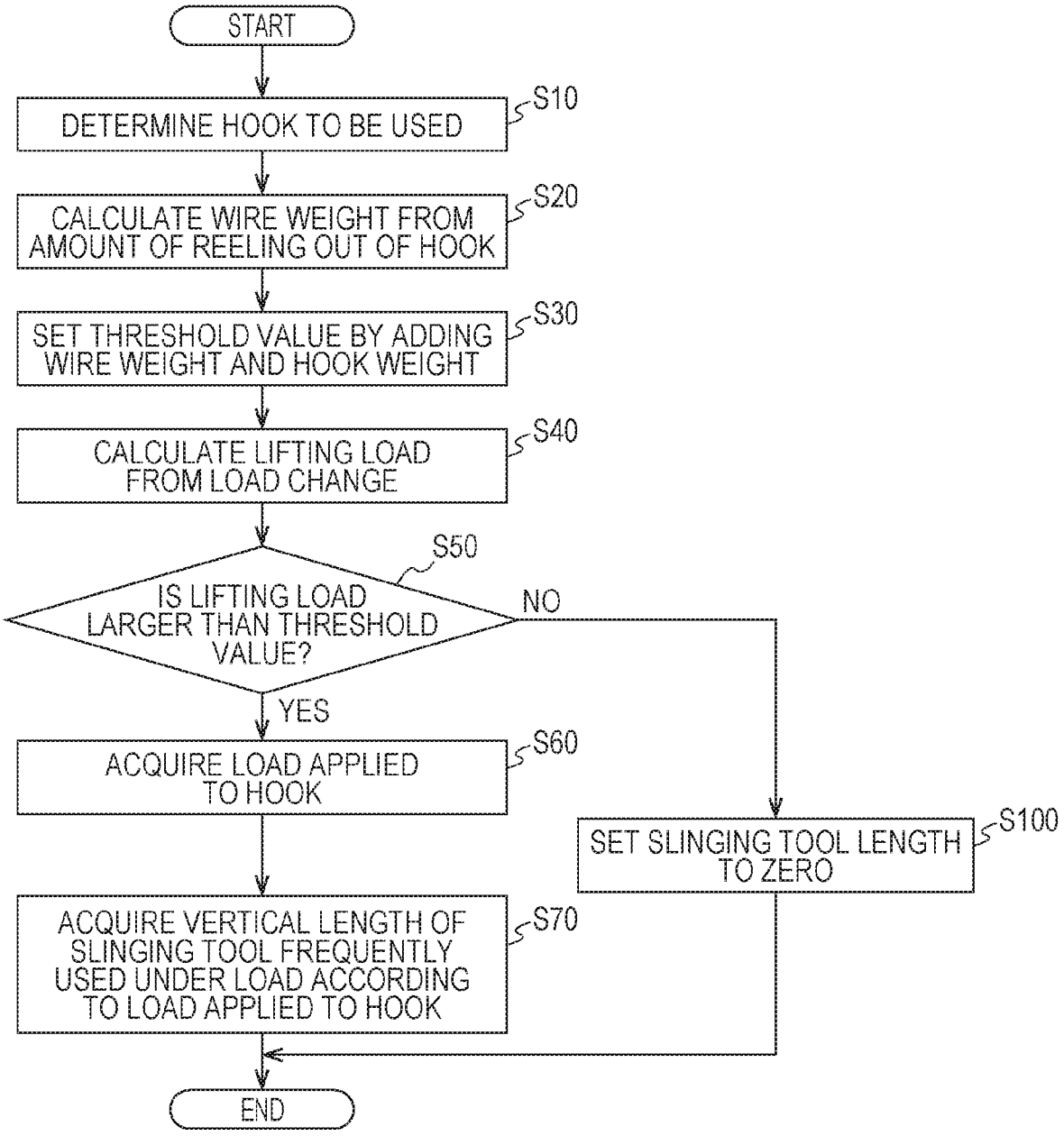
FIG. 6 is a diagram illustrating a flowchart illustrating a control mode according to a first embodiment of the control device of the crane.

The method for acquiring the vertical length h of the slinging tool according to the second embodiment is implemented by executing the following steps instead of step S70 in the flow of the method for acquiring the vertical length h of the slinging tool according to the first embodiment illustrated in FIG. 6. In the following, only steps that are alternatives to step S70 will be described, and since the other steps are the same as those in the first embodiment, a description thereof will be omitted.

In step S72, the control device 36 acquires the number of used slinging wire ropes WR input by the operator using input means (not illustrated). Then, the control device 36 causes the control process to proceed to step S74.

In step 374, the control device 36 calculates the load applied to each of the slinging wire ropes WR based on the load applied to the hook acquired in step S60 and the number of used slinging wire ropes WR acquired in step S72. Then, the control device 36 causes the control process to proceed to step S76.

In step S76, the control device 36 identifies the used slinging wire rope WR based on the load applied to each of the slinging wire ropes WR acquired in step S74 and the allowable load of the slinging wire ropes WR, etc. Subsequently, the control device 36 acquires the wire length Lw and the suspending angle θw determined according to the load applied to the hook from the slinging tool database unit 60. Then, the control device 36 causes the control process to proceed to step S78.

In step S78, the control device 36 calculates the vertical length h of the slinging wire ropes WR using the wire length Lw and the suspending angle θw of the slinging wire ropes WR acquired in step S76 ($h=Lw\times\cos\theta w$).

In the method for acquiring the vertical length of the slinging tool of the second embodiment, the same effect as that of the method for acquiring the vertical length of the slinging tool of the first embodiment is achieved, and it is possible to acquire the more accurate vertical length h of the slinging wire ropes WR.

As described above, the crane 1 may correspond to a case where the load W is suspended on the jib attached to the boom 9. The above-described embodiments merely show typical forms, and various modifications can be carried out without departing from the gist of one embodiment. Naturally, the crane and the method for acquiring the length of the slinging tool according to the invention can be implemented in various forms. In addition, the technical scope of the invention is shown by description of the claims, and further includes the equivalent meaning described in the claims and all changes within the scope.

<Appendix>

An aspect of a crane according to the invention can be configured to include a boom, a wire rope suspended down from a leading end section of the boom so that the wire rope can be freely wound and unwound, a suspender suspended down at a lower end of the wire rope and used to suspend a slinging tool hung on a load, and lifting load detection means that detects a lifting load by the wire rope, in which a resonance frequency of swing of the suspended load determined from the amount of reeling out of the wire rope is calculated, a control signal of an actuator is generated according to an operation of an operation tool, a filtering control signal for the actuator generated in which a frequency component in an arbitrary frequency range is attenuated at an arbitrary ratio with respect to the resonance frequency from the control signal, and the actuator is controlled.

In addition, such a crane may further include a slinging tool database unit that saves data in which a load applied to the suspender and a vertical length of the slinging tool corresponding to the load applied to the suspender are associated with each other. In addition, the crane may set a value obtained by adding the weight of the wire rope corresponding to the amount of reeling out of the wire rope from the leading end of the boom and the weight of the suspender as a predetermined threshold value. In addition, the crane calculates the lifting load from a load change of the lifting load detection means, and when the lifting load is larger than a predetermined threshold value, the crane acquires the vertical length of the slinging tool corresponding to the load applied to the suspender from the slinging tool database unit. On the other hand, when the lifting load is equal to or less than the predetermined threshold value, the crane may set the vertical length of the slinging tool to zero.

The content of the description, drawings, and abstract included in Japanese Patent Application No. 2018-035208 filed on Feb. 28, 2018 is incorporated herein by reference is its entirety.

REFERENCE SIGNS LIST

1 CRANE
10 MAIN HOOK BLOCK
10*a* MAIN HOOK
11 SUB-HOOK BLOCK
11*a* SUB-HOOK
12 HOISTING HYDRAULIC CYLINDER.
13 MAIN WINCH
14 MAIN WIRE ROPE
15 SUB-WINCH
16 SUB-WIRE ROPE
17 CABIN
18 TURNING OPERATION TOOL
19 HOISTING OPERATION TOOL
2 VEHICLE
20 EXPANSION/CONTRACTION OPERATION TOOL
21 MAIN DRUM OPERATION TOOL
22 SUB-DRUM OPERATION TOOL
25 TURNING SENSOR
26 BOOM LENGTH DETECTION SENSOR
27 WEIGHT SENSOR (LIFTING LOAD DETECTION MEANS)
28 HOISTING SENSOR
29 MAIN REELING OUT AMOUNT DETECTION SENSOR
3 WHEEL
30 SUB-REELING OUT AMOUNT DETECTION SENSOR
31 TURNING VALVE
32 EXPANSION/CONTRACTION OPERATION VALVE
33 HOISTING VALVE
34 MAIN VALVE
35 SUB-VALVE
36 CONTROL DEVICE
36*a* CONTROL SIGNAL GENERATION UNIT
36*b* RESONANCE FREQUENCY CALCULATION UNIT
36*c* FILTER UNIT
36*d* LOAD DETERMINATION UNIT
4 ENGINE
5 OUTRIGGER
6 CRANE DEVICE
60 SLINGING TOOL DATABASE UNIT
7 TURNING TABLE
8 TURNING HYDRAULIC MOTOR
9 BOOM
9*a* JIB
W LOAD
WR SLINGING WIRE ROPE
h VERTICAL LENGTH OF SLINGING TOOL
Lw WIRE LENGTH

The invention claimed is:

1. A crane comprising:

a boom;

a wire rope that is suspended down from a leading end section of the boom;

a suspender that is fixed to a lower end of the wire rope and is for suspending a slinging tool for hanging a load;

a calculation unit that calculates a first weight, which includes a weight of the load and a weight of the slinging tool suspended down from the suspender;

a slinging tool database unit that stores information pertaining to a plurality of different slinging tools, the information including specification information of each slinging tool of the plurality of different slinging tools as well as associations between the plurality of different slinging tools and respective lifting loads of different weights, wherein information pertaining to the slinging tool that is associated with a lifting load corresponding to the first weight is included within the information stored within the slinging tool database unit;

a determination unit that determines whether the load is being suspended from the suspender; and a control unit that acquires the information pertaining to the slinging tool that is associated with the lifting load corresponding to the first weight from the slinging tool database unit when the load is being suspended, and determines a vertical length of the suspended slinging tool on the basis of the acquired information pertaining to the slinging tool associated with the lifting load corresponding to the first weight.

2. The crane according to claim 1, wherein the specification information of the plurality of slinging tools include a wire length Lw of the slinging tool associated with the lifting load corresponding to the first weight and a suspending angle θw of the slinging tool associated with the lifting load corresponding to the first weight.

3. The crane according to claim 1, further comprising:

a resonance frequency calculation unit that calculates a resonance frequency of swing of the load based on the determined vertical length of the suspended slinging tool and an amount of reeling out of the wire rope;

a generation unit that generates a control signal corresponding to an operation of an operation tool for operating an actuator; and a filter unit that generates a filtering control signal in which a frequency component in a predetermined range is attenuated with respect to the calculated resonance frequency from the generated control signal.

4. The crane according to claim 1, wherein when the load is not suspended, the control unit sets the vertical length of the slinging tool to zero.

5. The crane according to claim 1, further comprising a load detection unit that detects a lifting load of the crane which is a sum of a rope weight corresponding to an amount of reeling out of the wire rope, a weight of the suspender, the weight of the suspended slinging tool, and the weight of a load suspended on the suspender, wherein the calculation unit calculates the first weight by subtracting the rope weight and the weight of the suspender from the lifting load of the crane.

6. The crane according to claim 5, wherein the determination unit performs the determination based on a first threshold value that is a sum of the rope weight and the weight of the suspender, and a detection value of the load detection unit.

7. A method for determining a vertical length of a suspended slinging tool in a crane including a boom, a wire rope that is suspended down from a leading end section of the boom, and a suspender that is fixed to a lower end of the wire rope and is for suspending the slinging tool for hanging a load, the method comprising:

calculating a first weight, which includes a weight of the load and a weight of the slinging tool suspended down from the suspender;

acquiring information pertaining to the slinging tool that is associated with a lifting load corresponding to the first weight from a slinging tool database unit when the load is being suspended, the slinging tool database unit storing information pertaining to a plurality of different slinging tools, the information including specification information of each slinging tool of the plurality of different slinging tools as well as associations between the plurality of different slinging tools and respective lifting loads of different weights, wherein information pertaining to the slinging tool that is associated with a lifting load corresponding to the first weight is included within the information stored within the slinging tool database unit; and determining a vertical length of the suspended slinging tool on the basis of the acquired information pertaining to the slinging tool associated with the lifting load corresponding to the first weight.

* * * * *